US010043368B1

(12) United States Patent
Fonzi, III et al.

(10) Patent No.: US 10,043,368 B1
(45) Date of Patent: Aug. 7, 2018

(54) FALL DETECTION SYSTEM

(71) Applicant: MSA Technology, LLC, Cranberry Township, PA (US)

(72) Inventors: Henry A. Fonzi, III, Cranberry Township, PA (US); William Richard Frank, Cranberry Township, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 0 days.

(21) Appl. No.: 15/486,897

(22) Filed: Apr. 13, 2017

(51) Int. Cl.
*G08B 21/04* (2006.01)
*G08B 21/08* (2006.01)

(52) U.S. Cl.
CPC ..... *G08B 21/043* (2013.01); *G08B 21/0446* (2013.01); *G08B 21/08* (2013.01)

(58) Field of Classification Search
CPC ... A47D 9/00; A47D 9/02; A47D 9/04; A47D 13/02; A61G 11/00; A61G 2200/14; H04L 29/08; H04L 67/12; G08B 21/01; G08B 21/02; G08B 21/043; G08B 21/0438; G08B 21/0446; G08B 21/0461; G08B 21/06; G08B 21/08; G08B 21/088; H08B 21/016
See application file for complete search history.

(56) References Cited

U.S. PATENT DOCUMENTS

| | | | | |
|---|---|---|---|---|
| 7,263,379 | B1 * | 8/2007 | Parkulo | G08B 21/02 340/501 |
| 9,734,690 | B2 * | 8/2017 | Haflinger | G08B 21/0446 |
| 9,754,470 | B2 * | 9/2017 | Ten Kate | G08B 21/0446 |
| 2001/0032059 | A1 | 10/2001 | Kelly, Jr. et al. | |
| 2010/0121226 | A1 * | 5/2010 | Ten Kate | A61B 5/1117 600/595 |
| 2014/0137324 | A1 * | 5/2014 | Doering | A47D 7/04 5/93.1 |
| 2015/0090751 | A1 | 4/2015 | Langford et al. | |
| 2016/0220153 | A1 | 8/2016 | Annegam et al. | |

FOREIGN PATENT DOCUMENTS

WO 2015036245 A1 3/2015

* cited by examiner

*Primary Examiner* — Van Trieu
(74) *Attorney, Agent, or Firm* — The Webb Law Firm

(57) ABSTRACT

A fall detection system includes at least one sensor configured to detect acceleration and orientation of a host, at least one indicator device having an alarm mode, and a controller operatively connected to the at least one sensor and the at least one indicator device. The controller is programmed to receive data generated by the at least one sensor, compare at least a portion of the received data with at least one specified parameter indicative of a fall event, and, based on the comparison, activating the at least one indicator device to enter the alarm mode. The at least one specified parameter includes at least one of the following: an acceleration exceeding a predetermined threshold, a change between a starting and a final orientation of the host before and after an acceleration event, a lack of movement of the host for a predetermined time after the acceleration event, or any combination thereof.

20 Claims, 3 Drawing Sheets

FALL DETECTION SYSTEM

CROSS-REFERENCE TO RELATED APPLICATIONS

This application claims priority to U.S. Provisional Application No. 62/323,266, entitled "Breathing Rate Detection System, Fall Detection System, and Ranging System for a Self-Contained Breathing Apparatus" and filed on Apr. 15, 2016, the disclosure of which is incorporated by reference herein in its entirety.

BACKGROUND OF THE INVENTION

Field of the Invention

The present invention relates generally to a fall detection system, and in particular, to a fall detection system configured for automatically detecting a fall event and issuing an alert that the fall event has occurred.

Description of the Related Art

There are many fields in which detecting and indicating whether an individual has fallen is highly desirable. Firefighting, for example, is a dangerous job with many known and unknown hazards that may cause the firefighter to fall down. Various personal alert safety system (PASS) devices have been developed to detect lack of motion of a firefighter. Typically, PASS devices are configured to monitor movement using a 3-axis accelerometer. If the PASS device does not detect user movement for a pre-determined length of time, such as 20 seconds, the PASS device goes into a pre-alarm state. If motion is detected during the pre-alarm state, the PASS device automatically resets and returns to a monitoring mode. However, if the PASS device does not detect motion for an additional pre-determined length of time (such as 10 seconds, or 30 seconds total), the PASS device goes into an alarm mode until it is manually reset.

While the existing PASS devices provide an important alert function in case a firefighter falls down, they are nonetheless associated with a number of disadvantages. If a fall event occurs (fall, building collapse, falling debris), and a firefighter is in danger, it may take 30 seconds for the conventional PASS device to go into full alarm mode to alert others that the firefighter has fallen. In a worst case scenario, this length of time may be a difference between life and death for the fallen firefighter. Furthermore, existing PASS devices may be activated into a pre-alarm state during routine firefighting operations, such as standing on a ladder or waiting to enter a fire scene. Activation of the PASS device in such situations is undesirable because it diverts the firefighter's attention from the task at hand. Additionally, existing PASS devices are not configured to detect a type of a fall event (e.g., falling down a set of stairs, falling through a floor or roof, or falling off a ladder), or an orientation of the firefighter relative to a reference plane (e.g., the ground) after the fall event. Thus, existing PASS devices cannot provide information about the type of distress that the firefighter may be experiencing after falling.

Similar fall detection devices have been developed for consumer use to issue an alert, such as by dialing an emergency number, when a user manually activates the device, such as by pressing a button. Other devices can automatically issue an alert after a fall is detected. However, such devices are configured to activate after detecting an acceleration or force that exceeds a pre-determined threshold. As a result, these devices may be activated in situations that do not involve a fall, such as jumping from an elevated position. In addition, these devices are not configured to detect an orientation of the user when a fall event is detected because they are typically worn loosely on the user's body.

Recently, mobile telephone applications have been developed which utilize the accelerometer of the mobile telephone to detect a fall event. These applications are similar to the PASS device in that they enter a pre-alarm mode for a pre-determined amount of time to allow the user an option to restore the application to a monitoring state. In addition, these devices are not configured to detect a type of a fall event, or an orientation of the user relative to a reference plane after the fall event.

While a variety of fall detection systems exist in the art, there is a continued need in the art for improved fall detection systems. For example, there is a need for an improved fall detection system that eliminates a pre-determined pre-alarm period before the system goes into a full alarm mode. There is a further need in the art for an improved fall detection system that is configured to detect a type of a fall event and activate an alarm based on the type of the fall event. There is an additional need in the art for an improved fall detection system that is configured to detect an orientation of the user relative to a reference plane after the fall event.

SUMMARY OF THE INVENTION

Generally, provided is an improved fall detection system that eliminates a pre-determined pre-alarm period before the system goes into a full alarm mode. Preferably, provided is an improved fall detection system that is configured to detect a type of a fall event and activate an alarm based on the type of the fall event. Preferably, provided is an improved fall detection system that is configured to detect an orientation of the user relative to a reference plane after the fall event.

In some preferred and non-limiting embodiments or aspects, provided is a fall detection system that may have at least one sensor configured to detect acceleration of a host, at least one indicator device having an alarm mode, and a controller operatively connected to the at least one sensor and the at least one indicator device, the controller programmed or configured to receive data generated by the at least one sensor, compare at least a portion of the received data with at least one specified parameter indicative of a fall event, and based on the comparison, activating or causing the activation of the at least one indicator device to enter the alarm mode. The at least one specified parameter may include at least one of the following: an acceleration exceeding a predetermined threshold, a change between a starting orientation of the host before an acceleration event and a final orientation of the host after the acceleration event, a lack of movement of the host for a predetermined length of time after the acceleration event, or any combination thereof.

In other preferred and non-limiting embodiments or aspects, the predetermined threshold for the acceleration event may be at least about 3 G. The predetermined length of time after the acceleration event may be in the range of about 0 seconds to about 5 seconds. The at least one sensor may be configured to detect at least one of static acceleration and dynamic acceleration. The at least one sensor may be at least one of the following: a 3-axis accelerometer, a 6-axis accelerometer, an omni-directional magnetometer, or any combination thereof. The at least one indicator device may be a visual indicator device. The visual indicator device may be at least one of a light-emitting diode and an infrared emitter. The at least one indicator device may be an audible indicator device. The audible indicator device may be at least one of a speaker and a piezo buzzer. The at least one indicator device may be a remote signaling indicator device programmed or configured for wireless communication with at least one remote device. The remote signaling indicator device may be programmed or configured to send at least one of a wireless short-range signal and a wireless long-range signal to the at least one remote device. A reset mechanism may be provided for turning off the at least one indicator after activation. A power source may be provided for supplying power to at least one of the following: the controller, the at least one sensor, the at least one indicator device, or any combination thereof.

In other preferred and non-limiting embodiments or aspects, provided is a self-contained breathing apparatus that may have a tank mounted on a rigid frame configured for mounting on a user's back using one or more straps and a fall detection system. The fall detection system may have at least one sensor connected to the rigid frame to detect acceleration of the user wearing the rigid frame, at least one indicator device having an alarm mode, and a controller operatively connected to the at least one sensor and the at least one indicator device, the controller programmed or configured to receive data generated by the at least one sensor, compare at least a portion of the received data with at least one specified parameter indicative of a fall event, and, based on the comparison, activate or cause the activation of the at least one indicator device to enter the alarm mode. The at least one specified parameter may include at least one of the following: an acceleration exceeding a predetermined threshold, a change between a starting orientation of the host before an acceleration event and a final orientation of the host after the acceleration event, a lack of movement of the host for a predetermined length of time after the acceleration event, or any combination thereof.

In some preferred and non-limiting embodiments or aspects, the predetermined threshold for the acceleration event may be at least about 3 G. The predetermined length of time after the acceleration event may be in the range of about 0 seconds to about 5 seconds. The at least one sensor may be configured to detect at least one of static acceleration and dynamic acceleration. The at least one sensor may be at least one of the following: a 3-axis accelerometer, a 6-axis accelerometer, an omni-directional magnetometer, or any combination thereof. The at least one indicator device may be at least one of a visual indicator device, an audible indicator device, and a remote-signaling indicator device. A reset mechanism may be for turning off the at least one indicator after activation.

Further preferred and non-limiting embodiments or aspects will now be set forth in the following numbered clauses.

Clause 1: A fall detection system comprising:

at least one sensor configured to detect acceleration and orientation of a host;

at least one indicator device having an alarm mode; and a controller operatively connected to the at least one sensor and the at least one indicator device, the controller programmed or configured to:

receive data generated by the at least one sensor;

compare at least a portion of the received data with at least one specified parameter indicative of a fall event; and based on the comparison, activating or causing the activation of the at least one indicator device to enter the alarm mode, wherein the at least one specified parameter comprises at least one of the following: an acceleration exceeding a predetermined threshold, a change between a starting orientation of the host before an acceleration event and a final orientation of the host after the acceleration event, a lack of movement of the host for a predetermined length of time after the acceleration event, or any combination thereof.

Clause 2: The fall detection system of clause 1, wherein the predetermined threshold for the acceleration event is at least about 3 G.

Clause 3: The fall detection system of clause 1 or 2, wherein the predetermined length of time after the acceleration event is in the range of about 0 seconds to about 5 seconds.

Clause 4: The fall detection system of any of clauses 1-3, wherein the at least one sensor is configured to detect at least one of static acceleration and dynamic acceleration.

Clause 5: The fall detection system of any of clauses 1-4, wherein the at least one sensor is at least one of the following: a 3-axis accelerometer, a 6-axis accelerometer, an omni-directional magnetometer, or any combination thereof.

Clause 6: The fall detection system of any of clauses 1-5, wherein the at least one indicator device is a visual indicator device.

Clause 7: The fall detection system of any of clauses 1-6, wherein the visual indicator device is at least one of a light-emitting diode and an infrared emitter.

Clause 8: The fall detection system of any of clauses 1-7, wherein the at least one indicator device is an audible indicator device.

Clause 9: The fall detection system of any of clauses 1-8, wherein the audible indicator device is at least one of a speaker and a piezo buzzer.

Clause 10: The fall detection system of any of clauses 1-9, wherein the at least one indicator device is a remote signaling indicator device programmed or configured for wireless communication with at least one remote device.

Clause 11: The fall detection system of any of clauses 1-10, wherein the remote signaling indicator is programmed or configured to send at least one of a wireless short-range signal and a wireless long-range signal to the at least one remote device.

Clause 12: The fall detection system of any of clauses 1-11, further comprising a reset mechanism for turning off the at least one indicator after activation.

Clause 13: The fall detection system of any of clauses 1-12, further comprising a power source for supplying power to at least one of the following: the controller, the at least one sensor, the at least one indicator device, or any combination thereof.

Clause 14: A self-contained breathing apparatus (SCBA) comprising:

a tank mounted on a rigid frame configured for mounting on a user's back using one or more straps; and a fall detection system comprising:

at least one sensor connected to the rigid frame and configured for detecting acceleration and orientation of the user wearing the rigid frame;

at least one indicator having an alarm mode; and a controller operatively connected to the at least one sensor for receiving data detected by the at least one sensor, analyzing the data detected by the at least one sensor for predetermined characteristics indicative of a fall event, and activating the at least one indicator to the alarm mode upon detecting data with the predetermined characteristics indicative of the fall event, wherein the predetermined characteristics of the fall event comprise an acceleration event exceeding a predetermined threshold, a change between a starting orientation of the user before the acceleration event and a final orientation of the user after the acceleration event, and a lack of movement of the user after the acceleration event.

Clause 15: The SCBA of clause 14, wherein the predetermined threshold for the acceleration event is at least 3 G.

Clause 16: The SCBA of clause 14 or 15, wherein the predetermined length of time after the acceleration event is 0 to 5 seconds.

Clause 17: The SCBA of any of clauses 14-16, wherein the at least one sensor is configured for detecting static acceleration and dynamic acceleration.

Clause 18: The SCBA of any of clauses 14-17, wherein the at least one sensor is one of a 3-axis accelerometer, a 6-axis accelerometer, and an omni-directional magnetometer.

Clause 19: The SCBA of any of clauses 14-18, wherein the at least one indicator device is at least one of a visual indicator device, an audible indicator device, and a remote-signaling indicator device.

Clause 20: The SCBA of any of clauses 14-19, further comprising a reset mechanism for turning off the at least one indicator after activation.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention.

DETAILED DESCRIPTION OF THE PREFERRED EXAMPLES

Figure 1:
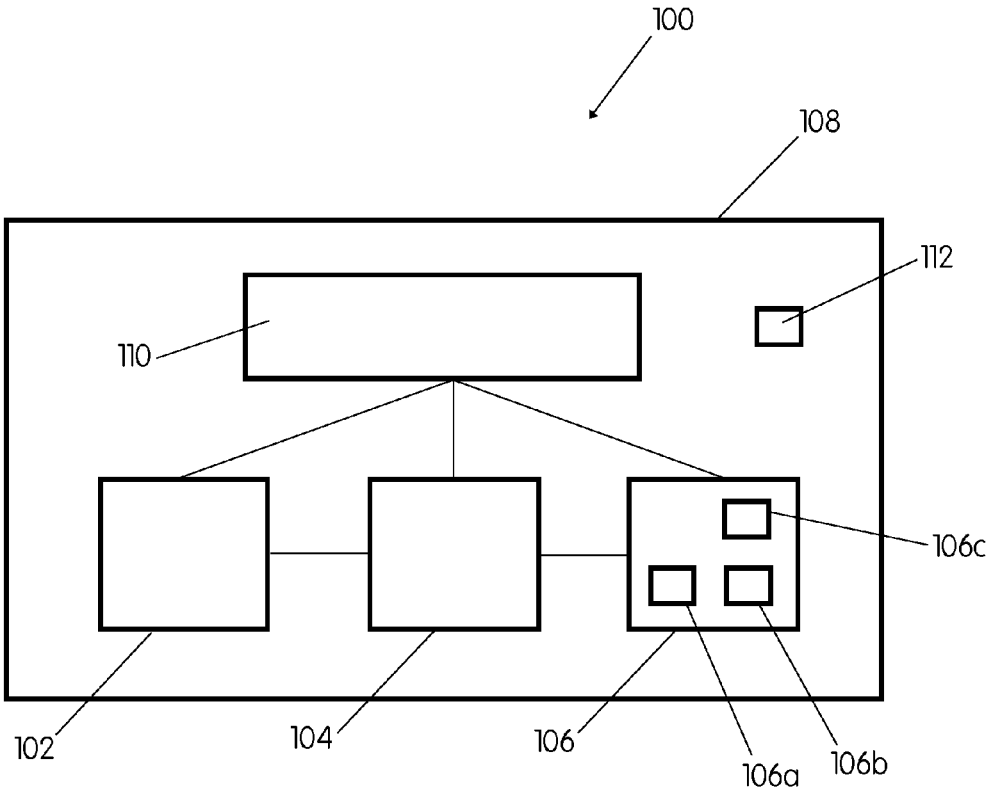
FIG. 1 is a schematic view of a fall detection system in accordance with one preferred and non-limiting embodiment or aspect of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used in the specification and the claims, the singular form of "a", "an", and "the" include plural referents unless the context clearly dictates otherwise. As used in the specification and the claims, all ranges or ratios disclosed herein are to be understood to encompass any and all subranges or sub-ratios subsumed therein. For aspect or embodiment, a stated range or ratio of "1 to 10" should be considered to include any and all subranges between (and inclusive of) the minimum value of 1 and the maximum value of 10; that is, all sub-ranges or sub-ratios beginning with a minimum value of 1 or more and ending with a maximum value of 10 or less, such as but not limited to, 1 to 6.1, 3.5 to 7.8, and 5.5 to 10.

As used in the specification and the claims, the term "fall event" means an unintended change in position of a user from a first position to a second position, wherein the first position and the second position differ in orientation or elevation of the user relative to the ground.

As used in the specification and the claims, the term "acceleration event" means a deviation of acceleration of an object from pre-determined range, such as but not limited to, 1 G to 3 G.

As used in the specification and the claims, the term "substantially parallel" means a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values. As used in the specification and the claims, the term "substantially perpendicular" means a relative angle as between two objects (if extended to theoretical intersection), such as elongated objects and including reference lines, that is from 85° to 95°, or from 87° to 93°, or from 89° to 91°, or from 89.5° to 90.5°, or from 89.9° to 90.1°, inclusive of the recited values.

Figure 2:
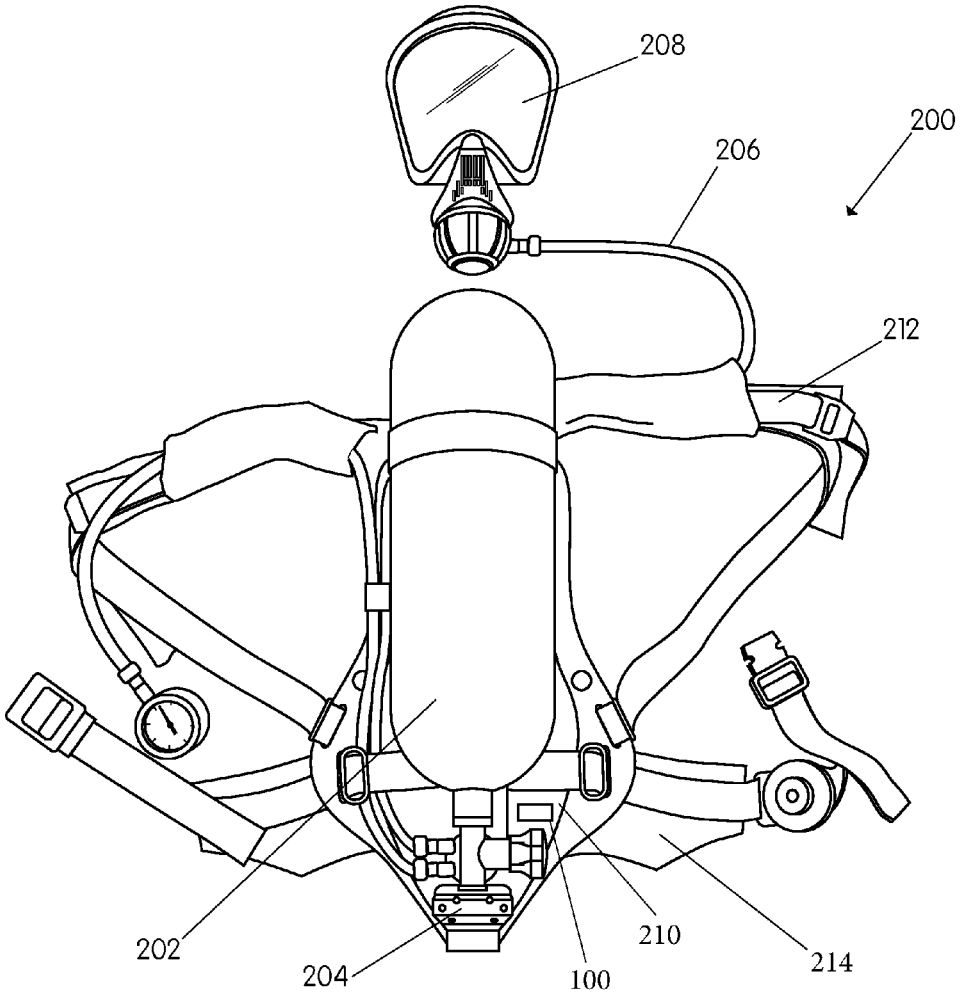
FIG. 2 is a perspective view of a self-contained breathing apparatus configured for use with the fall detection system of FIG. 1.
Figure 3:
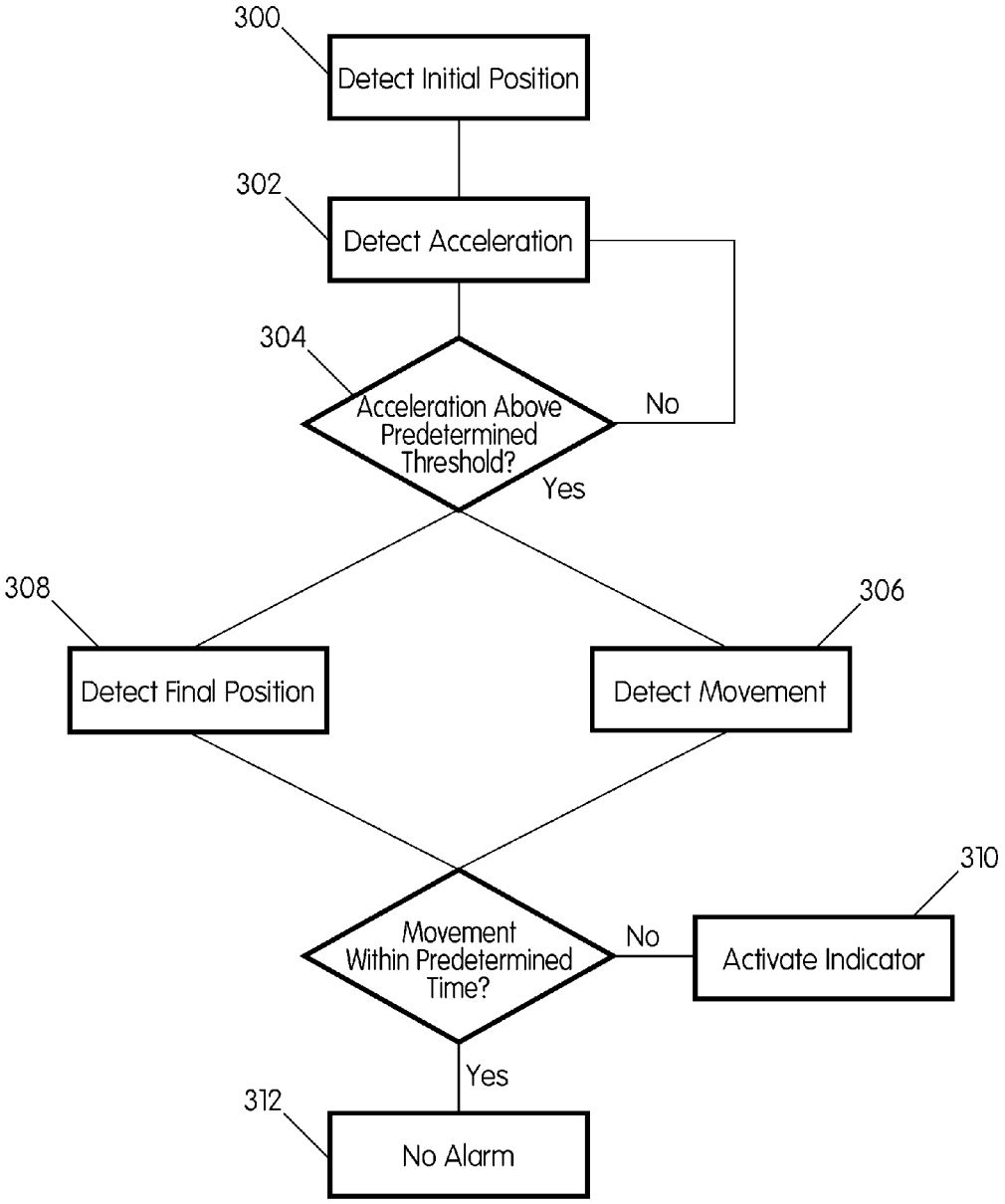
FIG. 3 is a flow chart of steps for activating an alarm mode of the fall detection system of FIG. 1.

In various preferred and non-limiting embodiments or aspects, and with reference to FIGS. 1-3, the present disclosure is directed to a fall detection system 100 configured for automatically detecting a fall event and issuing an alert that the fall event has occurred. As discussed herein, the fall detection system 100 may be configured to detect a type of a fall event and activate an alarm based on the type of the fall event. Additionally, the fall detection system 100 may be configured to detect an orientation of the user relative to a reference plane after the fall event. In various examples, the fall detection system 100 may be used with other equipment worn by the user, such as a harness, belt, or a frame for supporting equipment, such as a self-contained breathing apparatus (SCBA).

Fall Detector

With reference to FIG. 1, in one preferred and non-limiting embodiment or aspect, the fall detection system 100 has at least one sensor 102 (hereinafter referred to as "sensor 102") configured for detecting orientation and acceleration of a host, such as a user or an object configured to be worn by the user, in a three-dimensional space. The sensor 102 is operatively connected to a controller 104 configured for receiving information detected by the sensor 102, analyzing the information detected by the sensor 102 to determine whether the information is indicative of a fall event, and activate one or more indicator devices 106 (hereinafter referred to as "indicator device 106") if a fall event is detected.

In some embodiments or aspects, the sensor 102, controller 104, and indicator device 106 may be received within a housing 108 to define an integrated fall detection system 100. The housing 108 may be sealed to prevent water intrusion into an interior of the housing that receives the sensor 102, controller 104, and indicator device 106. The housing 108 may be made from a material that is resistant to heat such that functionality of the fall detection system 100 can be maintained even with exposure of the housing 108 to high heat (500° F.). In other examples, the components of the fall detection system 100 may be provided as separate items configured for interacting together. The fall detection system 100 may have a power source 110 for powering various components of the fall detection system 100. In some examples, the power source 110 may be integral with the housing 108 such that a single power source 110 provides power to the sensor 102, the controller 104, and the indicator device 106. In other examples, a plurality of power sources 110 may be provided, with each power source 110 powering at least one of the sensor 102, the controller 104, and the indicator device 106.

As discussed herein, the fall detection system 100 is configured to be worn by a user, either directly, such as by being connected to the body and/or clothing of the user, or indirectly, such as by being connected to equipment that is carried by the user. For example, the fall detection system 100 may be in the form of a bracelet, necklace, belt, or other accessory that is worn by the user, such as by being attached to the user's wrist, waist, neck, or other body part. In other examples, as discussed herein, the fall detection system 100 may be connected to a backpack or other accessory that is carried by the user.

Sensor

In various embodiments or aspects, the sensor 102 of the fall detection system 100 is connected to the user in such manner as to be capable of sensing a change in position of the user's body over time, such as acceleration, orientation, and distance. The sensor 102 may be an electronic or elecromechanical device that is configured to measure acceleration. In some embodiments or aspects, the sensor 102 may be configured to measure static acceleration, such as gravity, and/or dynamic acceleration, such as forces due to movement or vibration. For example, the sensor 102 may be an accelerometer configured for detecting acceleration in three reference axes (i.e., translation in X, Y, and Z axes). In other examples, the sensor 102 may be an accelerometer configured for detecting acceleration in three reference axes and rotation about each of the three axes (i.e., a 6-axis accelerometer). In further examples, the sensor 102 may be an omni-directional magnetometer. By measuring a magnitude of static acceleration due to gravity, the sensor 102 can be used to determine an angle at which the fall detection device 100 is tilted relative to the ground. Similarly, by sensing a magnitude of dynamic acceleration, the sensor 102 can be used to determine a direction in which the fall detection device 100 is moving. The sensor 102 may be operated continuously, or intermittently, such as in pre-determined active intervals separated by pre-determined inactive intervals. In each embodiment or aspect, the sensor 102 is configured for sensing for acceleration of the fall detection device 100 having pre-determined characteristics that are indicative of a fall event.

One of ordinary skill in the art will understand that the sensor 102 may be a single sensor, or an array of two or more sensors described hereinabove. For example, the sensor 102 may have a plurality of single- or dual-axis accelerometers combined together and configured for sensing acceleration due to translation and/or rotation in a three-dimensional space defined by, for example, a Cartesian coordinate system.

Controller

The data obtained by the sensor 102 is communicated to the controller 104, such as by a wired or wireless connection, for analyzing and determining whether the data contains any of the pre-determined characteristics of a fall event that the sensor 102 is configured to detect. For example, the pre-determined characteristics may include free fall, impact, and lack of motion. Based on the characteristics of this data (i.e., whether the data contains information regarding pre-determined characteristics of the fall event), the controller 104 can activate the indicator device 106 to provide an alert that a fall event has occurred.

As used herein, the controller 104 includes, or is operable to execute appropriate custom-designed or conventional software to perform and implement the processing steps of the method and system of the present disclosure, thereby forming a specialized and particular computing system. The controller 104 may include a variety of discrete computer-readable media components for analyzing information sensed by the sensor 102 and for activating the indicator device 106 when the information contains pre-determined characteristics indicative of a fall event. For example, this computer-readable media may include any media that can be accessed by the controller 104, such as volatile media, non-volatile media, removable media, non-removable media, transitory media, non-transitory media, etc. As a further example, this computer-readable media may include computer storage media, such as media implemented in any method or technology for storage of information, such as computer-readable instructions, data structures, program modules, or other data; random access memory (RAM), read only memory (ROM), electrically erasable programmable read only memory (EEPROM), flash memory, or other memory technology; CD-ROM, digital video disks (DVDs), or other optical disk storage; magnetic cassettes, magnetic tape, magnetic disk storage, or other magnetic storage devices; or any other medium which can be used to store the desired information and which can be accessed by the controller 104. Further, this computer-readable media may include communications media, such as computer-readable instructions, data structures, program modules, or other data in a modulated data signal, such as a carrier wave or other transport mechanism and may include any information delivery media, wired media (such as a wired network and a direct-wired connection), and wireless media (such as acoustic signals, radio frequency signals, optical signals, infrared signals, biometric signals, bar code signals, etc.). Of course, combinations of any of the above should also be included within the scope of computer-readable media. The controller 104 further may include a system memory with computer storage media in the form of volatile and non-volatile memory, such as ROM and RAM. A basic input/output system (BIOS) with appropriate computer-based routines assists in transferring information between components within the controller 104 and is normally stored in ROM. The RAM portion of the system memory typically contains data and program modules that are immediately accessible to or presently being operated on by the processing unit, e.g., an operating system, application programming interfaces, application programs, program modules, program data, and other instruction-based computer-readable codes.

Indicator

When the controller 104 determines that information sensed by the sensor 102 contains pre-determined characteristics of a fall event, the controller 104 may activate, by wired or wireless control, the indicator device 106. In some preferred and non-limiting embodiments or aspects, the indicator device 106 may be a visual indicator device 106*a*, an audible indicator device 106*b*, a remote signaling indicator device 106*c*, or any combination thereof. For example, the indicator device 106 may have one or more lights, such as one or more light-emitting diodes (LEDs), that are illuminated when the controller 104 activates the indicator device 106. The one or more lights may be lit continuously when the indicator device 106 is activated. Alternatively, the one or more lights may be lit intermittently at a predetermined interval or sequence. The visual indicator device 106*a* may be provided on the housing 108 and/or on an external device in communication with the fall detection device 100. For example, the visual indicator device 106*a* may be provided on a helmet worn by the user or another component connected to or worn by the user. In some examples, the visual indicator device 106*a* may have at least one infrared light source configured for being detected with a thermal imaging sensor.

In other preferred and non-limiting embodiments or aspects, the indicator device 106 may be an audio indicator device 106*b* having at least one speaker and/or a piezo buzzer. The at least one speaker and/or a piezo buzzer may be integrated with the housing 108 of the fall detection device 100, and/or on an external device in communication with the fall detection device 100. In further embodiments or aspects, the indicator device 106 may be a remote signaling indicator device 106*c* configured to provide a remote signal to an external device. For example, the indicator device 106 can wirelessly send a signal to an external device to indicate that a fall event has occurred. The remote signal can be a long-range (900 MHz) or a short-range (2,400 MHz) signal. The short-range signal may be configured for transmission from the fall detection device 100 to another local device, such as another user. The long range signal may be configured for transmission from the fall detection device 100 to a remote device using a cellular telephone network, or base stations with mobile or main command centers. In some examples, the remote device may be an incident command center at a fire scene. The indicator device 106 may be configured to indicate a position of the fall detection device 100 after a fall event has been detected.

In some preferred and non-limiting embodiments or aspects, the indicator device 106 may be configured to activate different types of alarms based on different fall events. For example, the indicator device 106 may activate a first indicator type, such as the visual indicator device 106*a*, if the fall event that is detected by the sensor 102 is indicative of falling down a set of stairs. The indicator device 106 may activate a second indicator type, such as the remote signaling indicator device 106*c*, if the fall event that is detected by the sensor 102 is indicative of a building collapse. One of ordinary skill in the art will appreciate that a plurality of indicator devices 106 can be activated simultaneously or sequentially depending on the type of fall event that is detected by the sensor 102.

In some preferred and non-limiting embodiments or aspects, the indicator device 106 may be reset after it has been activated. For example, a reset mechanism 112, such as a button, may be provided to turn off the indicator device 106 after activation. The reset mechanism 112 may be provided directly on the housing 108 of the fall detection system 100 to allow manual resetting of the indicator device 106 by the user. Alternatively, or in addition, the reset mechanism 112 may be provided on an external device in wireless communication with the fall detection system 100 to allow for remote resetting of the indicator device 106.

SCBA System

The fall detection system 100 may be integrated on equipment configured to be carried or worn by the user. In some preferred and non-limiting embodiments or aspects, the fall detection system 100 may be used with a helmet worn on a user's head. In other preferred and non-limiting embodiments or aspects, the fall detection system 100 may be configured for use with a self-contained breathing apparatus (SCBA). There exists a variety of SCBAs and similar systems, some of which are available through Mine Safety Appliances Company. Such SCBAs may be configured for use in a variety of applications, such as firefighting and industrial use. With reference to FIG. 2, an SCBA 200 has a tank 202, a pressure regulator 204 connected to the tank 202, and an air line 206 connecting the pressure regulator 204 to a mask 208. The tank 202 is mounted and supported on a rigid frame 210 that is worn on a user's back. A pair of shoulder straps 212 and a belt strap 214 are connected to the frame 210. The shoulder straps 212 and the belt strap 214 are configured to enable wearing of the SCBA 200 in a manner similar to a backpack, where the tank 202 and the frame 210 are positioned on the user's back.

The fall detection system 100 may be integrated with the SCBA 200. In some preferred and non-limiting embodiments or aspects, at least a portion of the fall detection system 100 may be connected to the frame 210 of the SCBA 200. For example, at least the sensor 102 of the fall detection system 100 may be positioned on the frame 210 of the SCBA 200. Positioning of at least a portion of the fall detection system 100 on the frame 210 provides several advantages. When worn by the user, the frame 210 is positioned close to the center of gravity of the user, regardless of the user's height and weight. In addition, the position of the frame 210 remains substantially unchanged relative to the user's body. In this manner, readings from the sensor 102 may be used to determine the orientation of the user based on the orientation of the frame 210.

Fall Detection System Operation

The fall detection system 100 may be configured to detect changes in orientation of the sensor 102 (and, therefore, changes in orientation of the user), measure acceleration experienced by the sensor 102 (and, therefore, a force experienced by the user), and sense movement of the sensor 102 (and, therefore, movement of the user). This information can be used by the controller 104 as criteria for analyzing whether movement of the sensor 102 (and, therefore, movement of the user) in a three-dimensional space can be characterized as a fall event.

In the firefighting field, users wearing an SCBA 200 at a fire scene will primarily be in the upright position, wherein the SCBA 200 and the frame 210 are oriented in a substantially vertical orientation relative to the ground, or in a crawling position, wherein the SCBA 200 and the frame 210 are oriented in a substantially horizontal position that is parallel and offset relative to the ground. The sensor 102 can be used to detect the orientation of the frame 210, and therefore the orientation of the user. Information detected by the sensor 102 can be used by the controller 104 to determine whether the orientation of the frame 210, and therefore the orientation of the user, falls within an expected orientation. For example, an expected orientation of the sensor 102 may be a vertical orientation (i.e., substantially perpendicular to the ground) at a height of approximately 36 inches from the ground, or a horizontal orientation (i.e., substantially parallel to the ground) and vertically offset relative to the ground at approximately 24 inches. Orientations of the sensor 102 that are not within these expected orientations (or within a pre-determined range from these expected orientations) may indicate that the user has fallen and may need assistance. For example, non-typical orientations of the user include, without limitation, if the user is upside-down or lying on his/her back. As discussed herein, data from the sensor 102 regarding the orientation of the sensor 102 may be used by the controller 104 as criteria for deciding whether an alarm mode should be initiated by activating the indicator device 106. For example, the controller 104 may use non-typical orientation of the sensor 102 (and, therefore, the user) as a trigger condition for initiating the alarm mode.

In addition to using the orientation of the sensor 102/frame 210 to determine the orientation of the user, the fall detection system 100 may use information regarding acceleration that is detected by the sensor 102 and correlate this information to a force experienced by the user. In some examples, the fall detection system 100 may use information regarding a magnitude and duration of acceleration during the acceleration event that is detected by the sensor 102, and correlate this information to a force experienced by the user. Depending on the magnitude of acceleration detected by the sensor 102 (and, optionally, duration of acceleration), the controller 104 can initiate an alarm mode by activating the indicator device 106 if the acceleration magnitude (and, optionally, acceleration duration) exceeds a pre-determined threshold (3 G). For example, a zero acceleration measurement in the vertical axis is indicative of a free fall condition. This zero acceleration measurement may be followed by a large positive acceleration, such as when the user hits the ground after free falling. If the positive measurement in acceleration after a zero measurement exceeds a pre-determined threshold (3 G), the controller 104 may initiate the alarm mode by activating the indicator device 106. Some acceleration events are typical (i.e. jumping off of a truck), while others (falling off of a roof, getting hit by a brick) can cause injury to the user. In this manner, acceleration events that are below the pre-determined threshold can be ignored, while acceleration events that are above the pre-determined threshold will result in activation of the indicator device 106 to provide an alert that the user has fallen.

In addition to using the orientation of the sensor 102/frame 210 to determine the orientation of the user and an acceleration experienced by the user, the fall detection system 100 may use information regarding motion of the sensor 102 (and, therefore, the user) after experiencing an acceleration event. In some preferred and non-limiting embodiments or aspects, the controller 104 may be configured to detect whether the user is stationary or moving after experiencing an acceleration event. For example, if a user is not moving within a pre-determined period of time, such as 0 to 5 seconds, after experiencing an acceleration event, this information may be indicative that the user has fallen and is unable to move. The controller 104 can activate the indicator device 106 to indicate that the user has fallen and that assistance is needed.

With reference to Table I below, various types of fall events are shown, such as falling from an elevated position, falling down a set of stairs, falling due building collapse, and falling due to being hit by an object. While not an exhaustive list, the fall events listed in Table I are the most typical fall events experienced by firefighters at a fire scene. For each fall event, the controller 104 analyzes data from the sensor 102 relating to the orientation of the user before an acceleration event, acceleration magnitude during the fall, acceleration magnitude during impact, final orientation of the user, and movement after the fall to determine whether an alarm should be activated.

TABLE I

| Type of Fall Event | Starting Orientation | Acceleration during fall event | Impact | Final orientation | Movement after fall event | Trigger Condition Sequence | Alarm |
|---|---|---|---|---|---|---|---|
| Fall from elevated position | Vertical (typical) | 0 | Large (60 G) | Non-vertical | No | Acceleration, Impact, Lack of Movement | Yes |
| Fall from elevated position | Vertical (typical) | 0 | Large (60 G) | Non-vertical | Yes | Acceleration, Impact, Movement | No |
| Fall from down stairs | Standing or crawling | High (60 G) | Medium (30 G) | Non-vertical | No | Acceleration, Impact, Lack of Movement | Yes |
| Fall down stairs | Standing or crawling | High (60 G) | Medium (30 G) | Non-vertical | Yes | Acceleration, Impact, Movement | No |
| Buidling collapse | Standing or crawling | Small (10 G) | Large (60 G) | Non-vertical | No | Impact, Lack of Movement Orientation | Yes |
| Building collapse | Standing or crawling | Small (10 G) | Large (60 G) | Non-vertical | Yes | Impact, Lack of Movement, Orientation | No |
| Flying object | Standing or crawling | Small (10 G) | Medium (30 G) | Non-vertical | No | Impact, Lack of Movement, Orientation | Yes |
| Flying object | Standing or crawling | Small (10 G) | Medium (30 G) | Non-vertical | Yes | Impact, Movement, Orientation | No |

For example, in a fall from an elevated position, such as when falling from a roof, the user may be initially in an upright position and end in a non-vertical position after falling. In addition, the user will experience zero acceleration during free falling, and a large acceleration upon impact. The controller 104 can automatically activate the indicator device 106 depending on whether the user is able to move within a pre-determined period of time (0 to 5 seconds) after falling.

After the controller 104 analyzes orientation, acceleration, and motion information from the sensor 102, the controller 104 can determine whether this information is indicative of a fall event, such as one of the fall events listed in Table I above, and automatically activate the indicator device 106. In some examples, the controller 104 may activate the indicator device 106 to communicate, via short-range signals, to other users in the vicinity of the fallen user. In this manner, other users can provide assistance to the fallen user. In other examples, the indicator device 106 may provide a visual or audible indication to the user that a fall event has occurred and ask the user to acknowledge whether assistance is needed. For example, the user can turn off the indicator device 106 via the reset mechanism 112 if the user is able to safely move after experiencing the fall event.

Having described the structure of the fall detection system 100 and the SCBA 200, a method of using the fall detection system 100 will now be described with reference to FIG. 3. Initially, the sensor 102 is configured to detect an initial position of the user (block 300) (e.g., standing or crawling), and use this value as a reference position. The controller 104 may continuously update the reference position to account for changes in the position of the user during use of the fall detection system 100. The sensor 102 is configured to detect all movement of the user in a three-dimensional space and correlate such movement to an acceleration measurement (block 302). Using the sensor data, the controller 104 determines whether the acceleration measured by the sensor 102 exceeds a pre-determined threshold value (block 304). If the acceleration measurement does not exceed the pre-determined threshold, the controller 104 continues to monitor the sensor data for any acceleration value that may exceed the acceleration threshold. If the controller 104 detects that the acceleration data from the sensor 102 exceeds the pre-determined threshold, the controller 104 analyzes sensor data regarding the position of the user after the acceleration event (block 306). The controller 104 also analyzes sensor data regarding movement of the user after the acceleration event (block 308). If movement of the user is detected within a predetermined length of time after the acceleration event, the controller 104 will not activate an alarm mode (block 310). However, if no movement of the user is detected within the predetermined length of time after the acceleration event, the controller 104 activates the alarm mode, wherein the indicator device 106 is activated to indicate that the user has fallen.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A fall detection system comprising:

at least one sensor configured to detect acceleration and orientation of a host;

at least one indicator device having an alarm mode; and a controller operatively connected to the at least one sensor and the at least one indicator device, the controller programmed or configured to:

receive acceleration and orientation data generated by the at least one sensor;

compare at least a portion of the received data with at least one specified parameter indicative of a fall event; and based on the comparison, activating or causing the activation of the at least one indicator device to enter the alarm mode, wherein the at least one specified parameter comprises at least one of the following: an acceleration exceeding a predetermined threshold, a change between a starting orientation of the host before an acceleration event and a final orientation of the host after the acceleration event, a lack of movement of the host for a predetermined length of time after the acceleration event, or any combination thereof, and wherein the at least one sensor is positioned proximate to a center of gravity of the host to determine the orientation of the host based on an orientation of the at least one sensor.

2. The fall detection system of claim 1, wherein the predetermined threshold for the acceleration event is at least about 3 G.

3. The fall detection system of claim 1, wherein the predetermined length of time after the acceleration event is in the range of 0 to about 5 seconds.

4. The fall detection system of claim 1, wherein the at least one sensor is configured to detect at least one of static acceleration and dynamic acceleration.

5. The fall detection system of claim 1, wherein the at least one sensor is at least one of the following: a 3-axis accelerometer, a 6-axis accelerometer, an omni-directional magnetometer, or any combination thereof.

6. The fall detection system of claim 1, wherein the at least one indicator device is a visual indicator device.

7. The fall detection system of claim 6, wherein the visual indicator device is at least one of a light-emitting diode and an infrared emitter.

8. The fall detection system of claim 1, wherein the at least one indicator device is an audible indicator device.

9. The fall detection system of claim 8, wherein the audible indicator device is at least one of a speaker and a piezo buzzer.

10. The fall detection system of claim 1, wherein the at least one indicator device is a remote signaling indicator device programmed or configured for wireless communication with at least one remote device.

11. The fall detection system of claim 10, wherein the remote signaling indicator device is programmed or configured to send at least one of a wireless short-range signal and a wireless long-range signal to the at least one remote device.

12. The fall detection system of claim 1, further comprising a reset mechanism for turning off the at least one indicator device after activation.

13. The fall detection system of claim 1, further comprising a power source for supplying power to at least one of the following: the controller, the at least one sensor, the at least one indicator device, or any combination thereof.

14. A self-contained breathing apparatus (SCBA) comprising:

a tank mounted on a rigid frame configured for mounting on a user's back using one or more straps; and a fall detection system comprising:

at least one sensor connected to the rigid frame to detect acceleration and orientation of the user wearing the rigid frame;

at least one indicator device having an alarm mode; and a controller operatively connected to the at least one sensor and the at least one indicator device, the controller programmed or configured to receive acceleration and orientation data generated by the at least one sensor, compare at least a portion of the received data with at least one specified parameter indicative of a fall event, and, based on the comparison, activate or cause the activation of the at least one indicator device to enter the alarm mode, wherein the at least one specified parameter comprises at least one of the following: an acceleration exceeding a predetermined threshold, a change between a starting orientation of the host before an acceleration event and a final orientation of the host after the acceleration event, a lack of movement of the host for a predetermined length of time after the acceleration event, or any combination thereof, and wherein the rigid frame and the at least one sensor are positioned proximate to a center of gravity of the user to determine the orientation of the user based on an orientation of the at least one sensor.

15. The SCBA of claim 14, wherein the predetermined threshold for the acceleration event is at least about 3 G.

16. The SCBA of claim 14, wherein the predetermined length of time after the acceleration event is the range of about 0 seconds to about 5 seconds.

17. The SCBA of claim 14, wherein the at least one sensor is configured to detect at least one of static acceleration and dynamic acceleration.

18. The SCBA of claim 14, wherein the at least one sensor is at least one of the following: a 3-axis accelerometer, a 6-axis accelerometer, an omni-directional magnetometer, or any combination thereof.

19. The SCBA of claim 14, wherein the at least one indicator device is at least one of a visual indicator device, an audible indicator device, and a remote-signaling indicator device.

20. The SCBA of claim 14, further comprising a reset mechanism for turning off the at least one indicator device after activation.

* * * * *